US006160525A

United States Patent [19]

Lopez

[11] Patent Number: 6,160,525

[45] Date of Patent: Dec. 12, 2000

[54] LOW IMPEDANCE LOOP ANTENNAS

[75] Inventor: Alfred R. Lopez, Commack, N.Y.

[73] Assignees: BAE SYSTEMS Aerospace Inc.; Advanced Systems, both of Greenlawn, N.Y.

[21] Appl. No.: 09/238,568

[22] Filed: Jan. 28, 1999

[51] Int. Cl.[7] ..... H01Q 11/12

[52] U.S. Cl. ..... 343/866; 343/867; 343/741; 343/742

[58] Field of Search ..... 343/866, 867, 343/741, 742, 870, 743, 725, 728; H01Q 11/12

[56] References Cited

U.S. PATENT DOCUMENTS

| | | | |
|---|---|---|---|
| 2,749,544 | 6/1956 | Pike | 343/867 |
| 5,142,292 | 8/1992 | Chang | 343/867 |
| 5,402,134 | 3/1995 | Miller et al. | 343/867 |
| 5,625,371 | 4/1997 | Miller et al. | 343/867 |

*Primary Examiner*—Hoanganh Le
*Attorney, Agent, or Firm*—Edward A. Onders; Kenneth P. Robinson

[57] ABSTRACT

Low impedance loop antennas utilize a loop separated into a plurality of radiating segments fed in parallel. A four point feed loop antenna, including radiating segments 12, 13, 14, 15 had a measured input impedance varying from 1.8 to 5.8 Ohms over a range of 5 to 15 MHz, without excessive radiation Q degradation. An incorporated feed network includes transmission line segments, with conductors on opposite surfaces of a thin substrate, connecting the radiating segments to a centrally mounted coaxial connector for parallel excitation. Operating bandwidth of the loop antenna is determined by the characteristic impedance of the transmission line feed segments. Low impedance loop antennas which are small relative to operating wavelength can be fabricated on a thin flexible substrate for field transport and use. Incorporation of the antenna into a jacket or other clothing enables field use while minimizing restriction of activity of the user.

17 Claims, 5 Drawing Sheets

LOW IMPEDANCE LOOP ANTENNAS

RELATED APPLICATIONS (Not Applicable)

FEDERALLY SPONSORED RESEARCH (Not Applicable)

BACKGROUND OF THE INVENTION

This invention relates to antennas and, more particularly to loop antennas having an input impedance which is low relative to prior antennas of this type.

Loop antennas of the general type illustrated in FIG. 4 are well known. For example, a square loop that is 0.5 meters on each side, formed of a conductor of one inch diameter, will have a reactance of about 37 Ohms at a frequency of 5 MHz.

U.S. Pat. No. 5,402,133 issued to J. T. Merenda on Mar. 28, 1995, ("Merenda") describes synthesizer radiating systems capable of providing efficient wideband operation with use of a small loop antenna. The word "small" being used to refer to antenna size relative to wavelength. The disclosure of the Merenda patent is hereby incorporated by reference herein.

In application of antenna systems in accordance with the Merenda patent it is desirable to provide low impedance loop antennas. In particular applications, the 37.3 ohm impedance of the loop antenna referred to above is higher, by a factor of about four, than the impedance level required in order to approach optimal performance in a Merenda antenna system implemented with available circuit devices separate from the antenna.

For use in Merenda antenna systems and other applications for very low impedance antennas it is, therefore, desirable to provide new forms of loop antennas characterized by low impedance without significant degradation of the radiation Q of the antenna system.

Objects of the present invention are to provide new and improved types of loop antennas and such antennas having one or more of the following advantages and characteristics:

low input impedance, relative to prior loop antennas;

limited Q degradation, relative to prior loop antennas;

small size, relative to operating frequency;

wideband operation;

incorporated feed network;

readily accommodated coaxial connector feed;

flexible, sheet construction;

economical fabrication; and sturdy, high-reliability construction.

SUMMARY OF THE INVENTION

In accordance with the invention, a loop antenna, characterized by low input impedance, includes a radiating element having the general form of a conductive loop about a central point, the loop separated into a plurality of radiating segments each having first and second ends. The antenna further includes first and second input/output terminals, a first conductor configuration coupling the first input/output terminal to the first end of each radiating segment, and a second conductor configuration coupling the second input/output terminal to the second end of each radiating segment.

Also in accordance with the invention, a loop antenna having four radiating sections includes a dielectric substrate having first and second main surfaces and divided into quadrants for reference purposes. A radiating element having the general form of a conductive loop is separated into four radiating segments, with each radiating segment positioned along the edge of one quadrant of the dielectric substrate and having first and second ends. The antenna further includes: first and second input/output terminals; four first conductors supported on the first main surface, each coupling the first input/output terminal to the first end of a different one of the radiating segments; and four second conductors supported on the second main surface, each coupling the second input/output terminal to the second end of a different one of the radiating segments.

For a better understanding of the invention, together with other and further objects, reference is made to the accompanying drawings and the scope of the invention will be pointed out in the accompanying claims.

DESCRIPTION OF THE INVENTION

Figure 1:
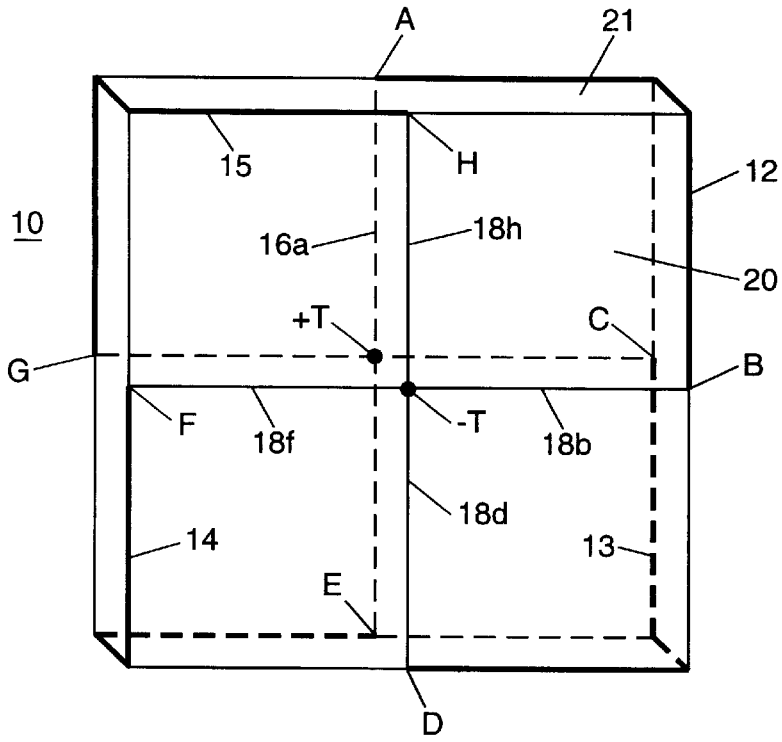
FIG. 1 is a perspective view of a low impedance loop antenna in accordance with the invention, wherein the loop consists of four parallel-excited radiating segments.
Figure 2:
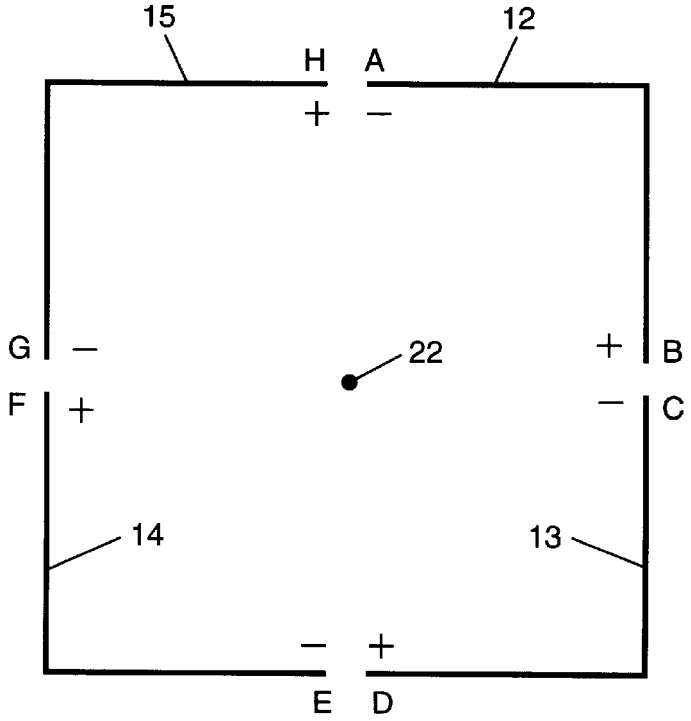
FIG. 2 is a simplified front view of the four radiating segments of the FIG. 1 antenna.
Figure 3:
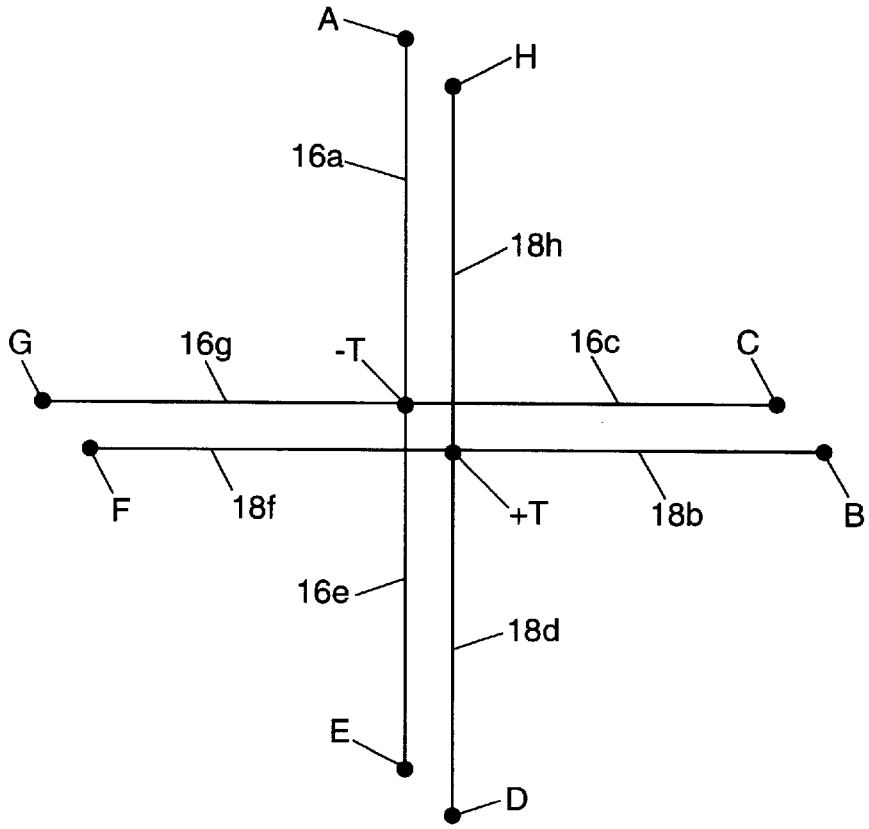
FIG. 3 shows the incorporated feed network of the FIG. 1 antenna, providing parallel excitation of all radiating segments via positive and negative input/output terminals.

A low impedance loop antenna 10 in accordance with the invention is illustrated in FIG. 1. FIGS. 2 and 3 represent the radiating segments and feed network portions of the FIG. 1 antenna, respectively.

As illustrated, the FIG. 1 antenna 10 includes a radiating element having the general form of a conductive loop. As represented in simplified form in FIG. 2, the loop is separated into four radiating segments 12, 13, 14, 15, each having first and second ends (i.e., respective ends A and B, C and D, E and F, and G and H.) As shown, the radiating segments 12–15 are serially positioned along the peripheral edge of a dielectric substrate 20.

As illustrated in FIG. 1, substrate 20 has first (back) and second (front) main surfaces, a finite thickness represented by peripheral edge 21, and a central point (represented as reference point 22 in FIG. 2). Substrate 20 may typically be a portion of a thin sheet of insulative material and in particular applications may be either stiff or flexible, for example. For purposes of description and reference, substrate 20 may be considered to be divided into quadrants (four similar reference portions) by the feed network conductors present in FIG. 1. In other embodiments, substrate 20 may be omitted and the radiating segments and supporting feed network fabricated to provide a self-supporting structure.

The FIG. 1 antenna includes first and second input/output terminals, shown respectively as terminals +T and −T. As will be described below, terminals +T and −T may be connected to the central conductor and outer conductor portions of a coaxial connector to facilitate connection of a coaxial cable for coupling signals to and from the antenna.

As shown the antenna 10 also includes a feed network comprising first and second conductor configurations. In the FIG. 1 embodiment, the first conductor configuration (as represented more particularly in FIG. 3) includes four first conductors 16*a*, 16*c*, 16*e* and 16*g*, each coupling the first input/output terminal +T to the first end of a different radiating segment (i.e., to first ends A, C, E and G of segments 12, 13, 14 and 15, respectively). The second conductor configuration includes four second conductors 18*b*, 18*d*, 18*f* and 18*h*, respectively coupling the second input/output terminal −T to the second ends B, D, F and H of the respective radiating segments.

In the illustrated embodiment, each of the radiating segments 12–15 is supported along the edge of one quadrant of the substrate 20, the feed conductors 16*a*, 16*c*, 16*e* and 16*g* are supported on the rear (first) surface of substrate 20, and the feed conductors 18*b*, 18*d*, 18*f* and 18*h* are supported on the front (second) surface of substrate 20. As noted, in other embodiments substrate 20 may be omitted and a self supporting structure utilized. With the FIG. 1 embodiment, substrate 20 may be quite thin and formed of any suitable material with individual conductors and radiating segments formed by printed circuit or other techniques and bonded or otherwise supported on the substrate. With individual conductors such as 16*a* and 18*h* superimposed (in opposed alignment) on opposite sides of a substrate, microstrip or other techniques may be employed to provide transmission line sections of appropriate characteristics for feeding the radiating segments. With use of a thin flexible substrate, an antenna such as illustrated in FIG. 1 may be provided in a form which can be rolled or folded to a small size, easily transported, and then opened for use. This enables an antenna which is of relatively small size to be rolled or folded to a smaller size for transport by an individual in preparation for use in the field. To minimize restriction of activity of an individual utilizing the antenna, it may be provided in a flexible form and incorporated into a jacket or other clothing for field use.

Figure 5:
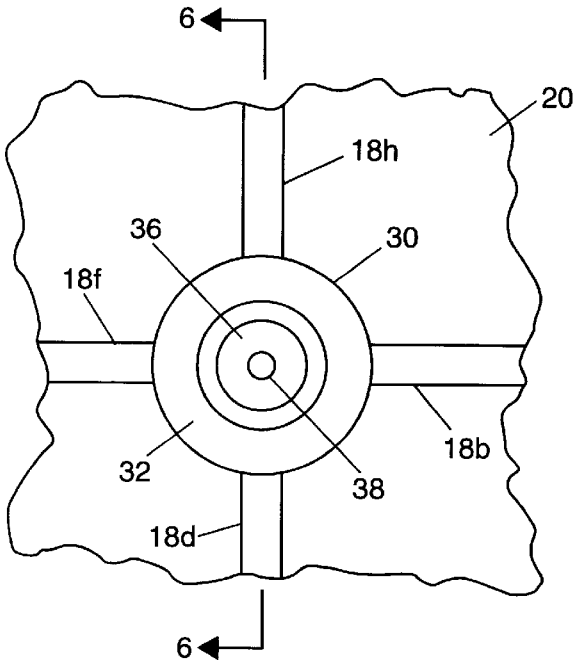
FIGS. 5 and 6 are front and side sectional views of a coaxial connector feed port connected to conductors representing the feed network conductors of the FIG. 1 antenna.
Figure 6:
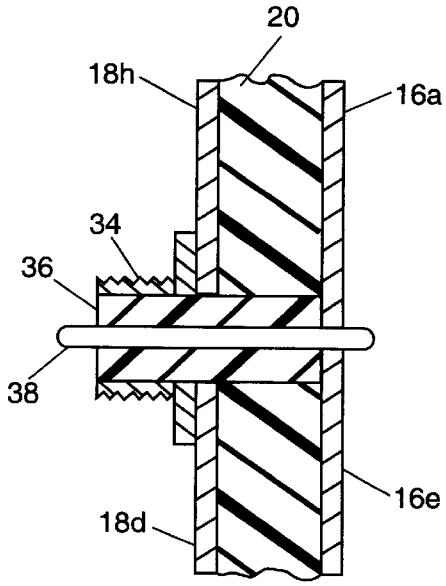

Referring now to FIGS. 5 and 6, there are shown simplified front and side sectional representations of a coaxial connector arrangement for coupling signals to and from the FIG. 1 antenna. While details in particular embodiments can be provided by skilled persons, in FIG. 5 input/output terminal −T has the form of an annular conductor at the junction of conductors 18*b*, 18*d*, 18*f* and 18*h*, including a circular central opening allowing insertion of portions of the coaxial connector 30. Such annular conductor is covered by and in contact with the circular base portion 32 of the outer shell of conductor 30 and is thus not visible in FIG. 5. As illustrated in FIG. 6, the threaded outer conductor portion 34 of the outer shell of coaxial connector 30 encircles an insulative sleeve 36 which supports inner conductor 38. As represented in FIG. 6, inner conductor 38 passes through a small central opening in terminal −T at the junction of conductors 16*a*, 16*c*, 16*e* and 16*g* at the back of the substrate 20. Solder contact may be provided at the back of the substrate, between the first feed conductor configuration and connector center conductor 38, and at the front of the substrate, between the second feed conductor configuration and the connector outer base portion 32. In use, a coaxial cable may readily be connected to the antenna via a cable connector mated with connector 30.

Figure 4:
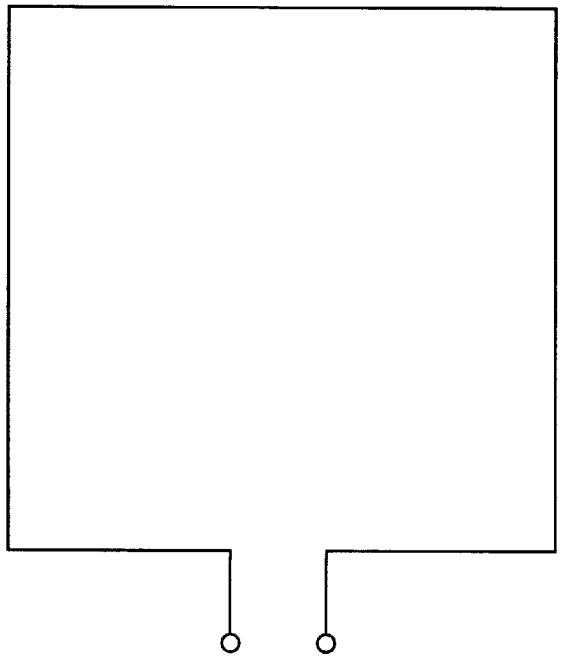
FIG. 4 PRIOR ART
FIG. 4 illustrates a prior art type of unitary loop antenna.

It will now be understood that the FIG. 1 antenna achieves a lowered input impedance based on use of a four point feed effective to provide parallel excitation of the four radiating segments 12–15. With an understanding of the four segment, four point feed loop antenna of FIG. 1, it will be appreciated that in use of the invention a loop may be separated into any plurality of radiating elements, as appropriate to meet impedance and other operating characteristics in a particular application. A fundamental characteristic of antennas utilizing the invention is that antenna input impedance is inversely related to the square of the number of radiating segments into which a loop is separated. Thus, for four segments, on a theoretical basis the impedance is reduced to one-sixteenth the impedance of a similar unitary loop (one-segment) prior art antenna (e.g., as shown in FIG. 4). The impedance of a two-segment loop is correspondingly reduced by a factor of four. In practice, when a multi-segment loop antenna is constructed pursuant to the invention, the measured impedance may differ to some extent from the theoretical value, as is to be expected in implementation of most antenna designs. For the FIG. 8 antenna (discussed below) which was fabricated and tested, measured parameters were closely consistent with the design parameters as computed.

Figure 7:
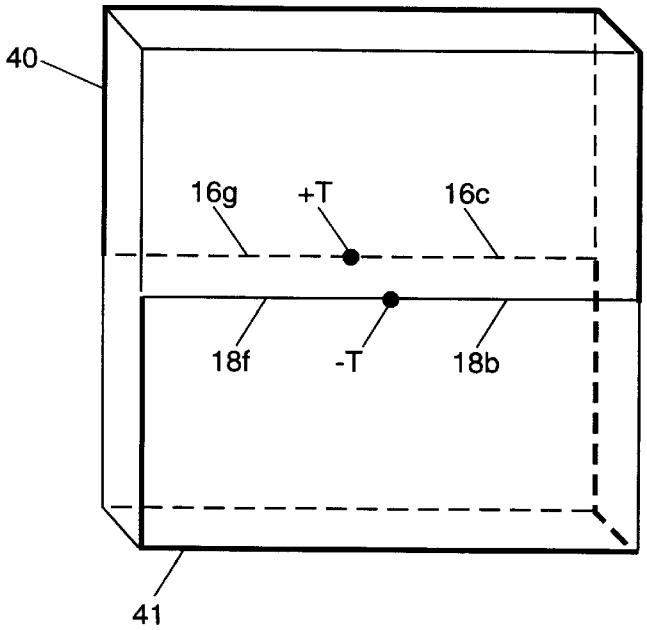
FIG. 7 shows a two-segment loop antenna in accordance with the invention in the same drawing format as FIG. 1.

FIG. 7 illustrates a loop antenna wherein the radiating element is separated into two radiating segments 40 and 41, each having one end connected to terminal +T and a second end connected to terminal −T. The FIG. 7 antenna may include a supporting substrate and coaxial connector as discussed with reference to FIGS. 1 and 6. A first conductor configuration (conductors 16*c* and 16*g*) and second conductor configuration (conductors 18*b* and 18*f*) connect the first and second ends of radiating segments 40 and 41 to the respective input/output terminals +T and −T, as shown.

In design of antennas using the invention, the effective impedance level and operational bandwidth are dependent upon the impedance of the transmission lines used in the feed network feeding the radiating segments, as well as upon the number of radiating segments. Thus, the conductors of the feed network illustrated in FIG. 3, which are supported on opposite sides of the substrate 20 of FIG. 1, comprise transmission line segments connected between the input/output terminals and the individual radiating segments. Through analysis, it was determined that if the transmission line sections are configured to have a characteristic impedance which results in the lowest possible antenna impedance level the operational bandwidth of the antenna will be reduced. Increasing the value of the transmission line impedance is effective to increase the operational bandwidth to approximate that of a prior art single segment, one point feed loop (FIG. 4) with little resulting degradation in the radiation Q of the antenna. Antenna systems as described in the Merenda patent utilize the loop inductance in the process of modulating the radiated signal. A rule of thumb useful in this regard is that the loop antenna is essentially an inductor up to a frequency that is one-half of the first resonant frequency of the loop. The first resonant frequency occurs when the loop circumference is equal to one-half wavelength. For a square loop 0.5 m. on a side, the first resonant frequency is 74.9 MHz and the maximum operating frequency is 37.5 MHz. Relative to a FIG. 4 single segment loop, having a maximum operating frequency of 37.5 MHz, an antenna reactance at 5 MHz of 28.9 Ohms, and a radiation Q degradation factor of zero or reference value, analysis indicates transmission line impedance affects a FIG. 7 type two segment loop antenna as follows. The two segment antenna design includes a square loop 0.5 m. on a side with a radiating segment strip width of 100 mm. (approximating 2 in. wire diameter). Computed values for that two segment loop with feed transmission lines of different characteristic impedance are as shown in the following table (as compared to the FIG. 4 one segment/one point feed antenna).

| Transmission Line Impedance (Ohms) | Maximum Operating Frequency (MHz) | Antenna Reactance at 5 MHz (Ohms) | Radiation Q Degradation Factor at 5 MHz (dB) |
|---|---|---|---|
| Ref., 1-point feed | 37.5 | 28.9 | 0 |
| 14.9 | 14.0 | 7.6 | 0 |
| 32.2 | 20.5 | 7.7 | 0.06 |
| 58.0 | 26.5 | 8.0 | 0.22 |
| 115.6 | 35.0 | 8.7 | 0.59 |

Thus, for a FIG. 7 type antenna if transmission line sections 16*c*/18*b* and 16*g*/18*f* are proportioned to have a characteristic impedance of the order of 115.6 Ohms, wideband operation is indicated.

Based on the foregoing description, pursuant to the invention a low impedance loop antenna may be provided having the property of an input impedance nominally equal to the input impedance of a unitary loop type loop antenna divided by $N^2$, where N is the number of radiating segments and N is an integral number greater than one. The term "nominally" is used to define an antenna impedance within plus or minus 20 percent of a stated value, in recognition of the fact that measured impedance of an antenna typically varies somewhat from computed theoretical value. A method of providing a low impedance loop antenna having an input impedance nominally equal to $1/N^2$ times the input impedance of a unitary loop type loop antenna includes the steps of:

(a) Providing a radiating element in the form of a conductive loop separated into N radiating segments, where N is an integer greater than one (e.g., 2, 3, 4, etc.).

(b) Providing feed conductors arranged to feed all N radiating segments in parallel (e.g., as in FIG. 3).

(c) Fabricating the feed conductors in the form of transmission line sections.

(d) Dimensioning the transmission line sections to have a characteristic impedance effective, in combination with the radiating segments, to provide a predetermined antenna operating frequency bandwidth (as discussed in relation to the table above).

(e) Supporting said radiating segments and transmission line sections on the surfaces of a thin dielectric substrate.

As will be appreciated, the foregoing steps are not necessarily included above in successive order, but may be implemented in appropriate order and combination by skilled persons once having an understanding of the invention.

Figure 8:
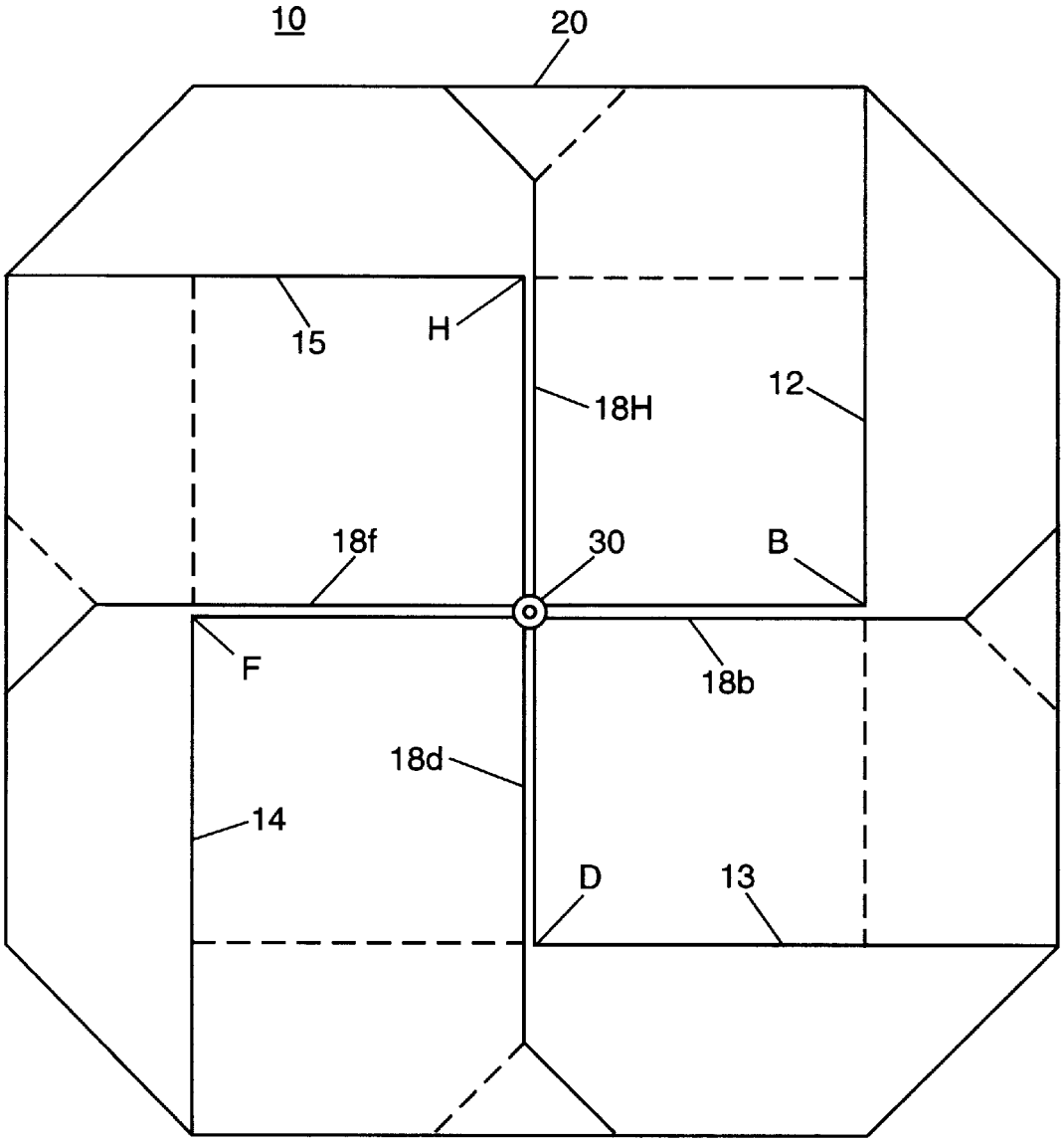
FIG. 8 is a front view of a FIG. 1 type four-segment loop antenna fabricated on a thin octagon-like substrate with foil-type radiating segments widened to provide reduced capacitive loading.

Referring now to FIG. 8, there is illustrated a four segment, four point feed loop antenna pursuant to the invention which was constructed and tested. The FIG. 8 antenna was constructed using copper foil radiating segments and feed conductor strips adhered to a thin fiberglass sheet, with a center-mounted coaxial conductor. The FIG. 8 antenna is thus an embodiment of the antenna described above with reference to FIGS. 1, 5 and 6. Specific design features of the FIG. 8 antenna include widening of the four radiating segments in order to reduce capacitive loading of the loop, and diagonal "clipping" of the corner of each quadrant of the substrate, resulting in a modified octagon shape. Viewing FIG. 8, with reference to FIG. 1, it will be seen that only segment end points B, D, F and H and feed network conductors 18*b*, 18*d*, 18*f* and 18*h* are visible in FIG. 8. The remaining segment end points and conductors 16*a*, 16*c*, 16*e* and 16*g* are on the reverse side of substrate 20. In this configuration, the first foil portion of segment 12 connected to conductor 18*b* is on the front of the substrate, the foil segment 12 then continues around the diagonal edge portion of substrate 20 and extends to the left on the back surface of the substrate to the not-visible point A where it connects to conductor 16*a*, which is behind conductor 18*h* and not visible in the FIG. 8 view. The remaining radiating segments 13, 14 and 15 similarly each have a front portion connected to one of conductors 18*d*, 18*f* and 18*g* and continue around on the back surface of the substrate for connection to one of conductors 16*c*, 16*e* and 16*g*, which are not visible in FIG. 8. An antenna of the type illustrated in FIG. 8 can be fabricated by use of printed circuit or other appropriate techniques. Coaxial connector 30 is positioned at the center of the substrate.

Computed values for the FIG. 8 antenna design of a size 0.5 m. on a side with feed transmission line sections of different characteristic impedance are as shown in the following table. Radiation Q will be quite high, and may be of the order of 200,000.

| Transmission Line Impedance (Ohms) | Maximum Operating Frequency (MHz) | Antenna Reactance at 5 MHz (Ohms) | Radiation Q Degradation Factor at 5 MHz (dB) |
|---|---|---|---|
| Ref., 1-point feed | 37.5 | 28.9 | 0 |
| 23.8 | 30 | 2.13 | 0 |
| 57.8 | 45 | 2.3 | 0.1 |
| 89.4 | 54 | 2.73 | 1.1 |
| 126.6 | 62 | 3.03 | 1.5 |

Figure 9:
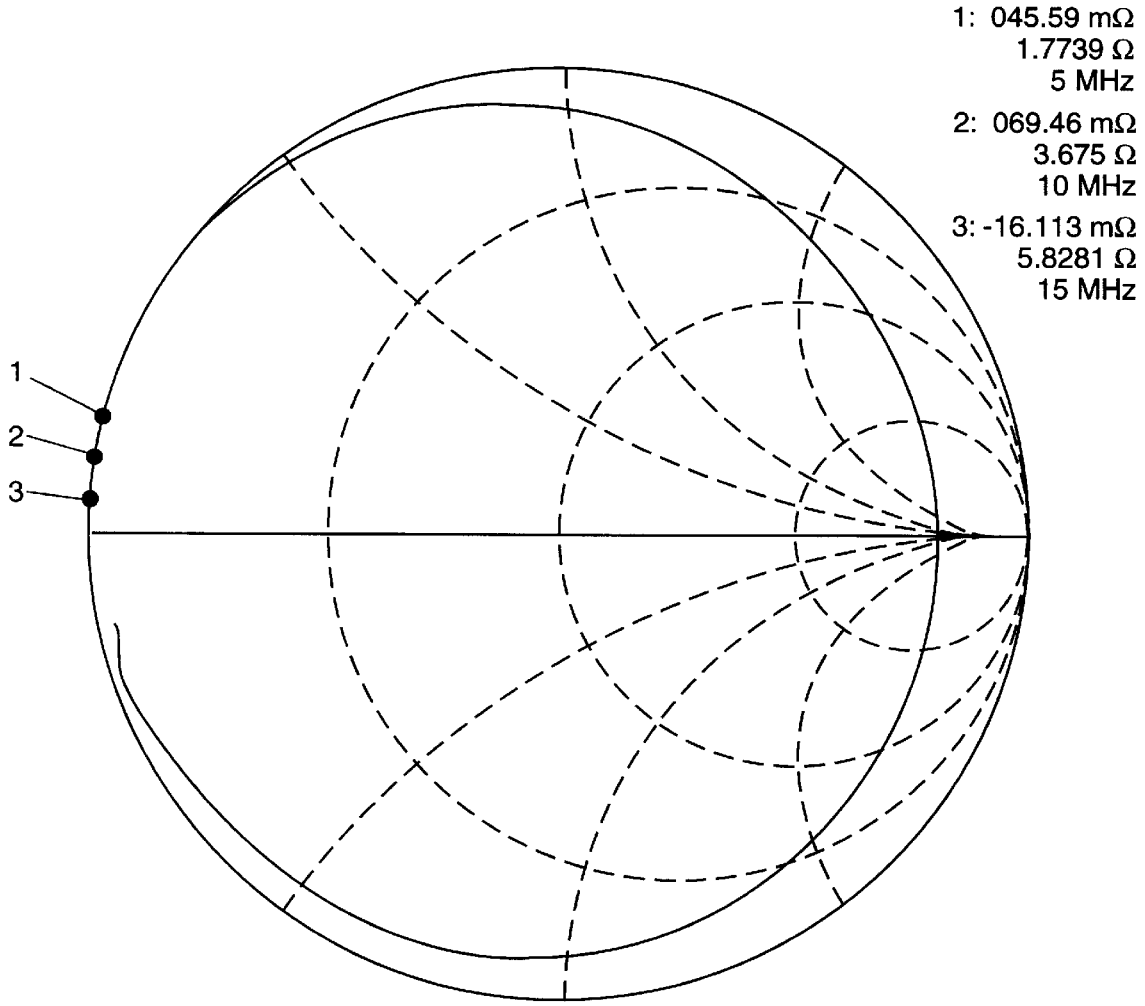
FIG. 9 is an impedance chart providing test results for the FIG. 8 antenna.

FIG. 9 provides results recorded during testing of a 0.5 m. antenna fabricated as illustrated in FIG. 8, using feed network segments having a characteristic impedance of about 20 Ohms. Measured reactive impedance of the four segment, four point feed antenna at different frequencies was: 1.8 Ohms at 5 MHz (FIG. 9, point 1), 3.7 Ohms at 10 MHz (point 2) and 5.8 Ohms at 15 MHz (point 3). Radiation Q adegradation was minimal, relative to the Q of a FIG. 4 single feed, single segment type loop. The tests thus confirm the capability of antennas constructed in accordance with the invention to provide low antenna impedance with wideband operating characteristics.

While there have been described the currently preferred embodiments of the invention, those skilled in the art will recognize that other and further modifications may be made without departing from the invention and it is intended to claim all modifications and variations as fall within the scope of the invention.

What is claimed is:

1. A loop antenna, characterized by low input impedance, comprising:

a radiating element having the general form of a conductive loop about a central point, said loop separated into a plurality of radiating segments each having first and second ends;

first and second input/output terminals;

a first conductor configuration coupling said first input/output terminal to the first end of each of said radiating segments;

a second conductor configuration coupling said second input/output terminal to the second end of each of said radiating segments; and a dielectric substrate supporting said radiating segments, with said first and second conductor configurations disposed on opposing main surfaces of the substrate.

2. A loop antenna as in claim 1, wherein said loop is separated into two radiating segments and said first and second conductor configurations each include two conductors arranged to provide parallel excitation of the two radiating segments.

3. A loop antenna as in claim 1, wherein said loop is separated into four radiating segments and said first and second conductor configurations each include four conductors arranged to provide parallel excitation of the four radiating segments.

4. A loop antenna as in claim 1, wherein said first and second conductor configurations include transmission line sections coupled from said first and second input/output terminals to respective ends of said radiating segments.

5. A loop antenna as in claim 4, wherein said transmission line sections are configured to have a characteristic impedance selected to cause said loop antenna to have at least a predetermined operating frequency bandwidth.

6. A loop antenna as in claim 1, additionally including a coaxial connector connected to said first and second input/output terminals.

7. A loop antenna, characterized by low input impedance, comprising:

a dielectric substrate having first and second main surfaces, a peripheral edge and a central point;

a radiating element having the general form of a conductive loop separated into a plurality of radiating segments serially positioned along said peripheral edge, each radiating segment having first and second ends;

first and second input/output terminals;

a first conductor configuration supported on said first main surface and coupling said first input/output terminal to the first end of each of said radiating segments; and a second conductor configuration supported on said second main surface and coupling said second input/output terminal to the second end of each of said radiating segments.

8. A loop antenna as in claim 7, additionally including a coaxial connector connected to said first and second input/output terminals.

9. A loop antenna as in claim 7, wherein said loop is separated into two radiating segments and said first and second conductor configurations each include two conductors arranged to provide parallel excitation of the two radiating segments.

10. A loop antenna as in claim 7, wherein said loop is separated into four radiating segments and said first and second conductor configurations each include four conductors arranged to provide parallel excitation of the four radiating segments.

11. A loop antenna as in claim 7, wherein said first and second conductor configurations include transmission line sections coupled from said first and second input/output terminals to respective ends of said radiating segments.

12. A loop antenna as in claim 7, wherein portions of said first and second conductor configurations are in opposed alignment on opposite sides of said substrate to provide transmission line sections of predetermined characteristic impedance connected to said radiation segments.

13. A loop antenna as in claim 12, wherein said transmission line sections are configured to have a characteristic impedance selected to cause said loop antenna to have at least a minimum operating frequency bandwidth.

14. A loop antenna, characterized by low input impedance, comprising:

a dielectric substrate having first and second main surfaces and divided into quadrants for reference purposes;

a radiating element having the general form of a conductive loop separated into four radiating segments, each radiating segment positioned along the edge of one quadrant of said dielectric substrate and having first and second ends;

first and second input/output terminals;

four first conductors supported on said first main surface, each coupling said first input/output terminal to the first end of a different one of said radiating segments; and four second conductors supported on said second main surface, each coupling said second input/output terminal to the second end of a different one of said radiating segments.

15. A loop antenna as in claim 14, additionally including a coaxial connector connected to said first and second input/output terminals.

16. A loop antenna as in claim 14, wherein individual conductors of said first four conductors are in opposed alignment to individual conductors of said second four conductors on opposite main surfaces of said substrate, to provide transmission line sections of predetermined characteristic impedance connected to said radiating segments.

17. A loop antenna as in claim 14, wherein said substrate is formed of thin flexible insulative material.

* * * * *